US008256303B2

(12) United States Patent
Attwater et al.

(10) Patent No.: US 8,256,303 B2
(45) Date of Patent: Sep. 4, 2012

(54) METHOD OF OPERATING A SHIPLIFT

(75) Inventors: Iain J. Attwater, Arnold, MD (US); Iver D. Cayocca, Coral Gables, FL (US); Richard J. Shanks, Arnold, MD (US)

(73) Assignee: Rolls-Royce Naval Marine, Inc., Walpole, MA (US)

( * ) Notice: Subject to any disclaimer, the term of this patent is extended or adjusted under 35 U.S.C. 154(b) by 272 days.

(21) Appl. No.: 12/847,542

(22) Filed: Jul. 30, 2010

(65) Prior Publication Data

US 2010/0298969 A1 Nov. 25, 2010

Related U.S. Application Data

(62) Division of application No. 11/629,685, filed as application No. PCT/US2005/021194 on Jun. 16, 2005, now Pat. No. 7,766,577.

(60) Provisional application No. 60/579,677, filed on Jun. 16, 2004.

(51) Int. Cl.
*G01B 5/30* (2006.01)
*G06F 7/00* (2006.01)

(52) U.S. Cl. ..... 73/760; 700/213

(58) Field of Classification Search ..... 73/760; 700/213

See application file for complete search history.

(56) References Cited

U.S. PATENT DOCUMENTS

| | | | | |
|---|---|---|---|---|
| 2,401,878 | A | 6/1946 | McClain | |
| 3,073,125 | A | 1/1963 | Pearlson | |
| 3,777,691 | A | 12/1973 | Beale | |
| 4,087,979 | A | 5/1978 | Pearlson | |
| 4,329,082 | A | 5/1982 | Gillis | |
| 4,661,749 | A | 4/1987 | Finkbeiner | |
| 5,178,488 | A | 1/1993 | Stokoe | |
| 5,314,263 | A | 5/1994 | Stokoe | |
| RE36,971 | E | 11/2000 | Stokoe | |
| RE37,061 | E | 2/2001 | Stokoe | |
| 2008/0292402 | A1 * | 11/2008 | Attwater et al. | 405/3 |

(Continued)

FOREIGN PATENT DOCUMENTS

| | | |
|---|---|---|
| JP | 55353895 | 5/1978 |

(Continued)

OTHER PUBLICATIONS

EPO Office Action dated Jul. 14, 2010 from related application.

(Continued)

*Primary Examiner* — Andre Allen

(74) *Attorney, Agent, or Firm* — Timothy J. Klima; Shutteworth & Ingersoll, PLC

(57) ABSTRACT

A platform includes main transverse beams ("MTBs"), each supported by at least one hoist. It is determined whether a load on any MTB is different from the load on any other MTB by more than a predetermined amount. An MTB which has a load different from the load on any other MTB by more than a predetermined amount is selected and then vertically moved with respect to the other MTBs within a predetermined safety limit to transfer load between the selected MTB and the other MTBs while monitoring the loads on each MTB and the position of the selected MTB as vertical movement of the selected MTB proceeds. The monitored loads and position are compared with the safety limit; and the movement of the selected MTB stopped when either the desired load transfer is completed or the safety limit has been met.

20 Claims, 11 Drawing Sheets

U.S. PATENT DOCUMENTS

| | | | | |
|---|---|---|---|---|
| 2010/0292830 | A1* | 11/2010 | Attwater et al. | 700/213 |
| 2010/0292831 | A1* | 11/2010 | Attwater et al. | 700/213 |
| 2010/0298970 | A1* | 11/2010 | Attwater et al. | 700/213 |

FOREIGN PATENT DOCUMENTS

| | | |
|---|---|---|
| JP | H06500962 | 2/1994 |
| JP | H0940379 | 2/1997 |
| NL | 9002650 | 7/1992 |

OTHER PUBLICATIONS

Japanese Office Action dated Apr. 14, 2010 from related application.

* cited by examiner

METHOD OF OPERATING A SHIPLIFT

CROSS-REFERENCE TO RELATED APPLICATIONS

This application is a divisional of U.S. patent application Ser. No. 11/629,685 filed May 12, 2008 and claims priority to U.S. Patent Application No. 60/579,677 filed Jun. 16, 2004 and PCT Application No. PCT/US2005/021194 filed Jun. 16, 2005, which applications are incorporated by reference herein.

U.S. application Ser. No. 11/629,685 is the National Phase of International Application PCT/US2005/021194 filed Jun. 16, 2005 which designated the U.S. and that International Application was published under PCT Article 21(2) in English.

BACKGROUND OF THE INVENTION

The present invention relates to shiplifts, and in particular, to a method of operating a shiplift.

A shiplift generally includes two rows of hoists connected on opposite sides of a lifting platform. The hoists can be of many types, including electrically or hydraulically driven winches or hydraulic rams, and can be connected to the platform in alternative manners, including by wire rope or chain. The number and size of hoists employed can be varied as desired depending on the load to be lifted. A typical shiplift will utilize between 4 and 110 hoists.

The platform of a shiplift can be rigid or, as supplied by the assignee of the present application, can be articulated such that portions of the platform can be moved vertically relative to other portions of the platform. In a platform of the type typically used by the assignee of the present invention, the platform includes a plurality of main transverse beams ("MTBs") that are able to articulate with respect to one another within a specified range of movement. Each MTB is supported between two hoists connected at opposite ends of the MTB. The MTBs are connected together in a known manner to form the platform while still allowing relative movement between respective MTBs. In some circumstances, the platform can be constructed of two or more sections that can be operated together for lifting larger ships/vessels, or can be operated independently of one another for independently lifting two or more smaller ships/vessels.

An example of a prior art shiplift with which the present invention can be used is described in U.S. Pat. No. RE37,061, "Method of Distributing Loads Generated Between A Ship And A Supporting Dry Dock", assigned to the assignee of the present invention and shown herein in FIGS. 1-4. Referring to FIG. 1, a platform 13 of the kind described in U.S. Pat. No. 4,087,979 supports a ship 9 for vertical movement with respect to a quay 10 (FIG. 2). Referring now to FIG. 2, the platform 13 includes a plurality of MTBs 20, the ends of which lie within cutouts 17 in the opposing faces of the guays 10 (FIG. 1) and 12 (FIG. 4). The ends of the beams 20 carries sheaves 18.

A plurality of opposed pairs of hoists are used, here in the form of hoist winches 19. See FIG. 4. Each hoist winch 19 is fixed to its respective quay and supports a further sheave 21 in approximately vertical alignment with the sheaves 18, and further includes a winch drum 29. See FIGS. 2 and 3. A wire rope 27 is fixed by one end to a load cell 25 which also doubles as a clevis pin and is fixed to the end of the structure of the hoist winch 19. The rope 27 is wrapped around the sheaves 18 and 21, the remaining end exiting sheaves 18 and being connected to the winch drum 29. Each winch drum 29 is driven by an ac synchronous motor 33 via a step down gear arrangement 35 and a toothed wheel 37 on the end of the drum 29. A limit switch 41 is fastened to the structure of the hoist winch 19 and a contact pad 43 is carried by the beam 20. The limit switch is pre-set and when the platform 13 rises to its desired height during operation, the pad 43 contacts the limit switch 41 which then is actuated to effect halting of the platform 20. Devices (not shown) within the system are utilized to determine the maximum desired lowered positions of the platform 13.

During operation of the hoist winches 19 to raise or lower the platform 13 and its associated ship 9, a conditioning circuit 28 receives electrical signals from the load cell 25 associated with that winch 19. See FIG. 4. The output from each circuit 28 is sent to computer/CPU 47. The computer 47 can process the data received and send control signals to the shiplift control panel, stopping or allowing operation of the hoist winches 19, and can send further signals to a visual display unit 49 so as to display information concerning the operating performance of the hoist winches 19, e.g. the loads being sensed, and also the current being drawn by the winch motor 33, the weight of the vessel being lifted/lowered and other characteristics of the system.

FIG. 5 shows a display in both histogram and numerical form of the distribution of a particular ship's weight over the hoist winches 19. Opposed winch stations 1A and 1B are each experiencing a load of 73.8 tons. Stations 4A and 4B are each experiencing a load of 256 tons and stations 6A and 6B are each experiencing a load of 72 tons. The weights indicated from zero upwards relate to the ship. The projections of the histogram below the zero line are identical in extent, and correspond to the constant weight of the platform.

The foregoing description discloses the use of a load cell 25 in the form of a clevis pin. However, other forms of load cell may be used, and positioned anywhere in the load path of the loads which the hoist winches 19 experience during operation. Thus, by way of example, load cells can be positioned on the support structure 51 of the hoist winch sheaves 21, or at 53 between the hoist winches 19 and the quays 10 and 12, or at the clevis pin supports. i.e., through use of a normal clevis pin 25 supported on a load cell of appropriately adapted shape.

A known shiplift control system supplied by the assignee of the present application, marketed under the name ATLAS™, provides shiplift operating information to the shiplift operator. For instance, it includes a calculated load distribution screen that indicates the probable distributed load of a vessel calculated from data input by the operator. If any distributed load is above the maximum designed distributed load, the monitor will display a warning that the vessel may overload the shiplift and should not be docked. If a warning is indicated, the distribution of the vessel load on the blocks may be changed by moving the center of gravity closer to the centerline of the loaded blocking. The following docking parameters are entered by the operator:

W=The ship load.

LK=The length of blocks to be bearing the keel.

A=The distance of the first block to the shore bulkhead in meters (feet).

LCG=The distance from the center of gravity of the ship to the shore bulkhead.

The setting limits will be shown in a window of the display, together with an input setting box for the value input. The display will show the calculated load distribution for the vessel to be docked.

The ATLAS™ system also includes a center of gravity mode which provides information on the vessel's longitudinal and transversal center of gravity on the platform and the shipload on each main transverse beam.

This information can be used by the operator to identify any docking abnormalities such as incorrect vessel positioning.

U.S. Pat. RE36,971, "Method Of Determining And Analyzing A Ship's Weight" and RE37,061, "Method of Distributing Loads Generated Between A Ship And A Supporting Dry Dock", both describe methods of operating a shiplift.

U.S. Pat. Nos. 3,073,125, 4,087,979, RE36,971 and RE37,061, all related to shiplifts and assigned to the assignee of the present invention or corporate predecessors, are incorporated by reference herein.

SUMMARY OF THE INVENTION

A platform includes main transverse beams ("MTBs"), each supported by at least one hoist. It is determined whether a load on any MTB is different from the load on any other MTB by more than a predetermined amount. An MTB which has a load different from the load on any other MTB by more than a predetermined amount is selected. At least one safety limit by which the selected MTB can be vertically moved with respect to adjacent MTBs is determined and then the selected MTB is vertically moved with respect to the other MTBs within a predetermined safety limit to transfer load between the selected MTB and the other MTBs while monitoring the loads on each MTB and the position of the selected MTB as vertical movement of the selected MTB proceeds. The monitored loads and position are compared with the safety limit; and the movement of the selected MTB stopped when either the desired load transfer is completed or the safety limit has been met.

In an alternative embodiment, a method for operating a lifting mechanism having a platform and a plurality of irregularly spaced blocking mechanisms to support a load of an item to be lifted on the platform, includes collecting position data on each of the blocking mechanisms with respect to the platform, estimating a mass of the item to be lifted and estimating a longitudinal center of gravity of the item to be lifted. An estimated loading curve on the platform based on the position of the irregularly spaced blocking mechanisms, the mass and longitudinal center of gravity of the item to be lifted is calculated and the estimated loading curve outputted.

In an alternative embodiment, a method for operating a lifting mechanism having a platform, a plurality of hoists to lift the platform and a plurality of blocking mechanisms to support a load of an item to be lifted on the platform, includes collecting position data on each of the blocking mechanisms and reading a load on each hoist. A load on each blocking mechanism based on the position of each blocking mechanism, the loads on each hoist and a predetermined relationship between a stiffness of the platform and its load is calculated and the calculated load on each blocking mechanism is outputted.

In an alternative embodiment, a method for operating a lifting mechanism having a platform, a plurality of hoists to lift the platform and a plurality of blocking mechanisms to support a load of an item to be lifted on the platform, includes collecting position data on each of the blocking mechanisms and reading a load on each hoist. An estimated tons per meter loading on the platform based on the load on each hoist, the positioning of each blocking mechanism and a length of the platform is calculated and the estimated tons per meter calculation outputted.

In an alternative embodiment, a method for operating a lifting mechanism includes activating a monitoring operation of the lifting mechanism upon start-up of the lifting mechanism, monitoring certain operating parameters of the lifting mechanism, comparing the operating parameters with predetermined trigger parameters, and logging the operating parameters in the event that any of the trigger parameters are met.

In an alternative embodiment, a method for operating a lifting mechanism, includes activating a monitoring system upon activation of the lifting mechanism control, selecting a set of system parameters to monitor, and selecting a set of triggering criteria for at least certain of the system parameters. The system parameters are then monitored until any of the triggering criteria met and then the system parameters are logged to a persistent memory once any of the triggering criteria are met.

It is an object of the present invention to provide solution to the problems described in the background section.

It is an object of the present invention to provide a method or methods for operating a lifting mechanism that provides the features and/or advantages described herein.

BRIEF DESCRIPTION OF TILE DRAWINGS

The invention will now be described, by way of example and with reference to the accompanying drawings in which.

DETAILED DESCRIPTION OF THE INVENTION

Figure 1:
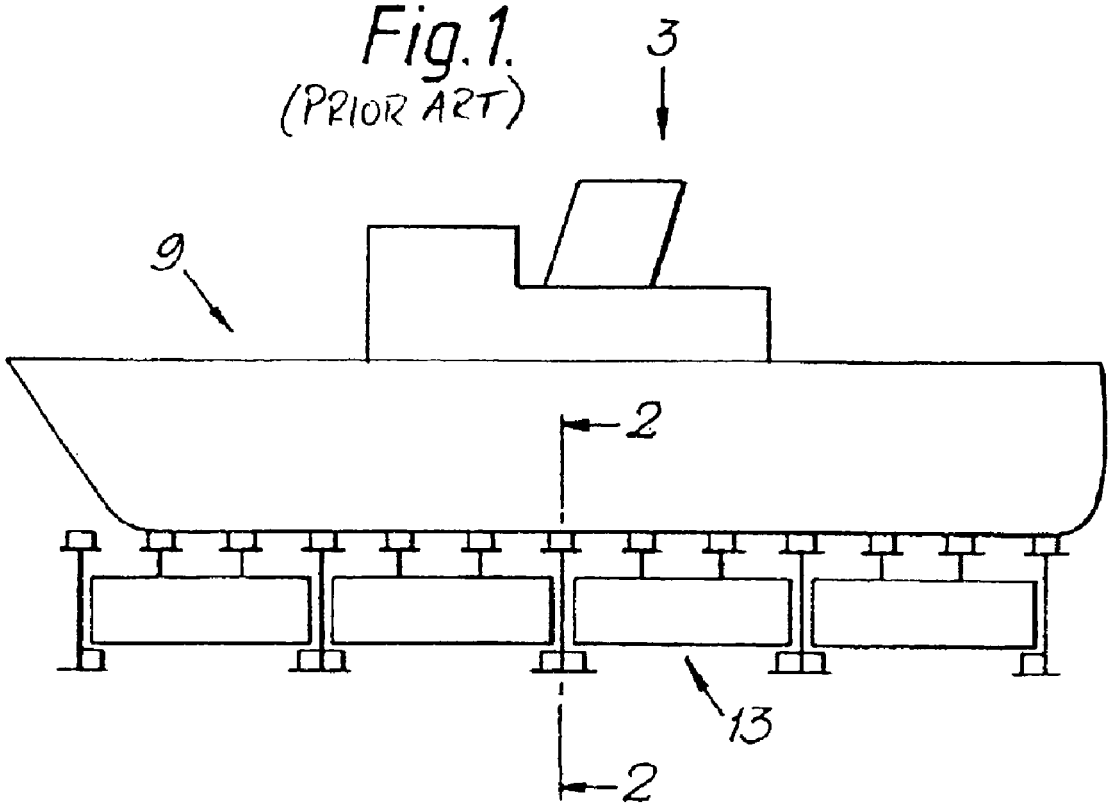
Fig. 1. (PRIOR ART)
FIG. 1 (Prior Art) is a diagrammatic side elevation view of a shiplift.
Figure 2:
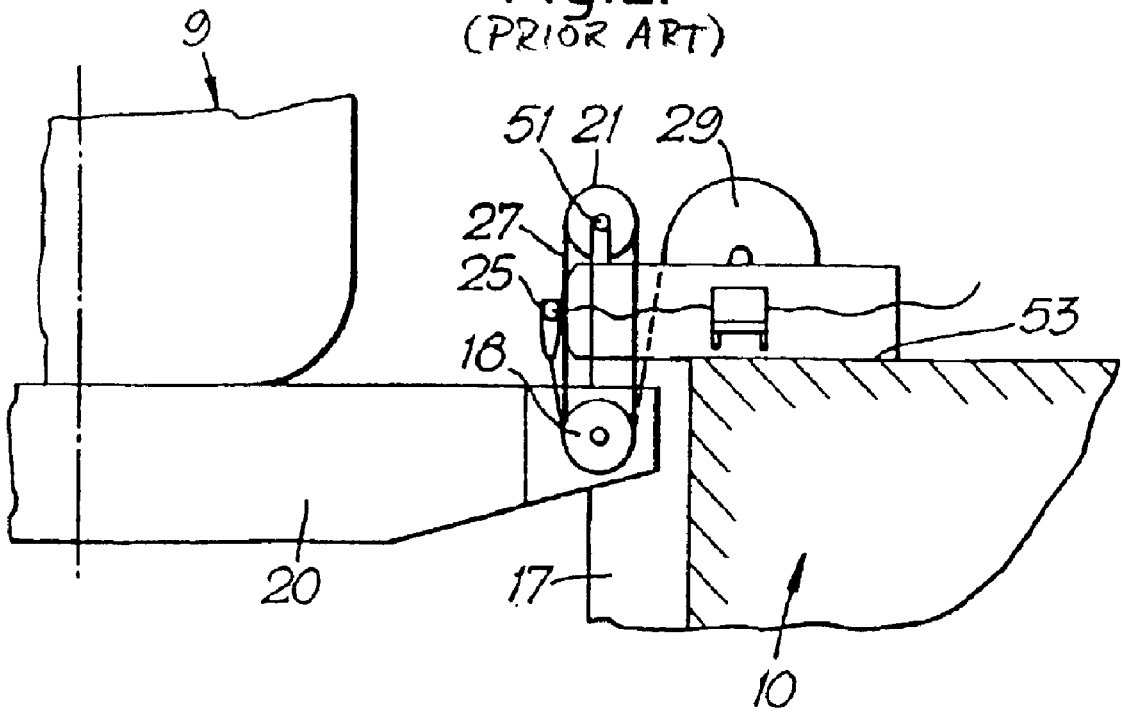
Fig. 2. (PRIOR ART)
FIG. 2 (Prior Art) is a partial diagrammatic view on line 2-2 of FIG. 1.
Figure 3:
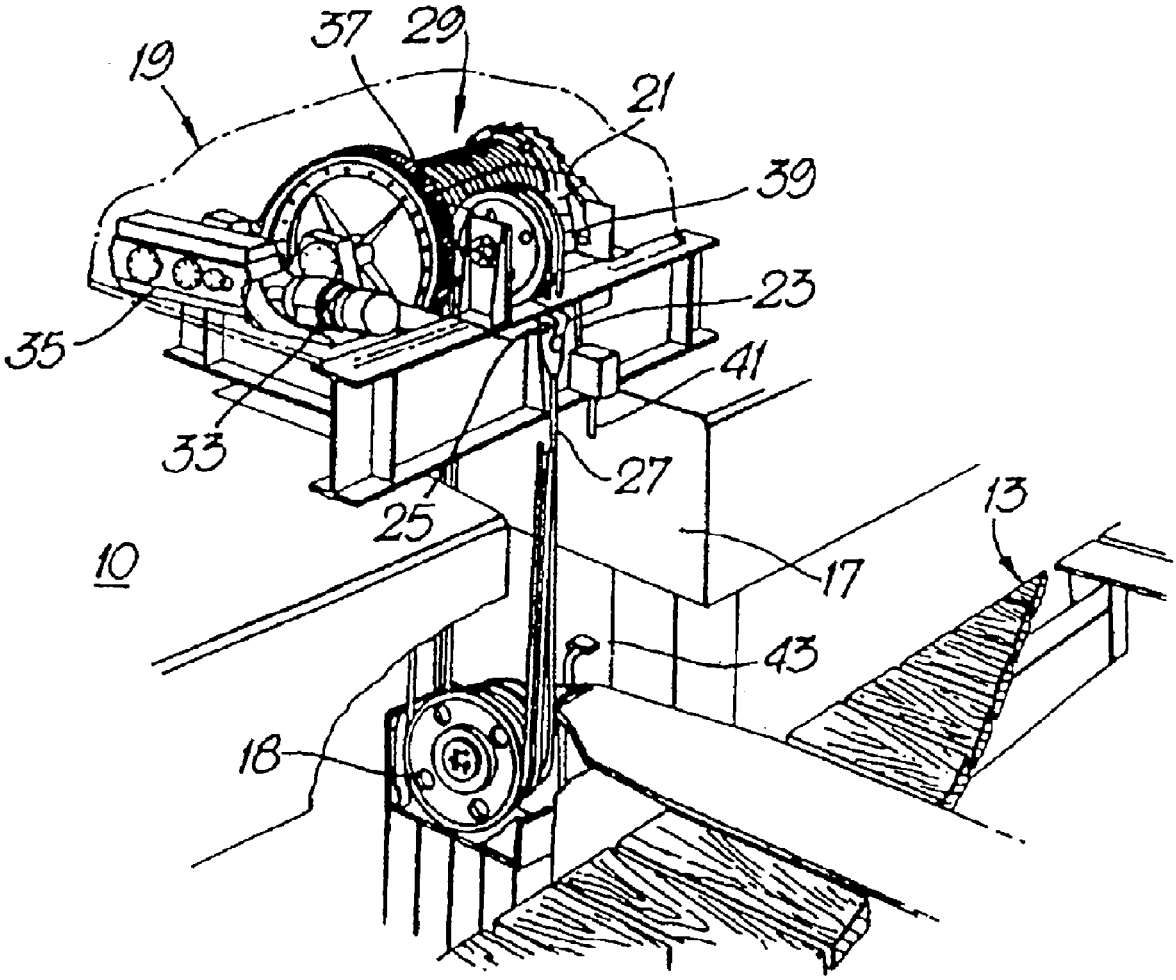
Fig. 3. (PRIOR ART)
FIG. 3 (Prior Art) is a pictorial view of a hoist winch of the shiplift of FIG. 1.
Figure 4:
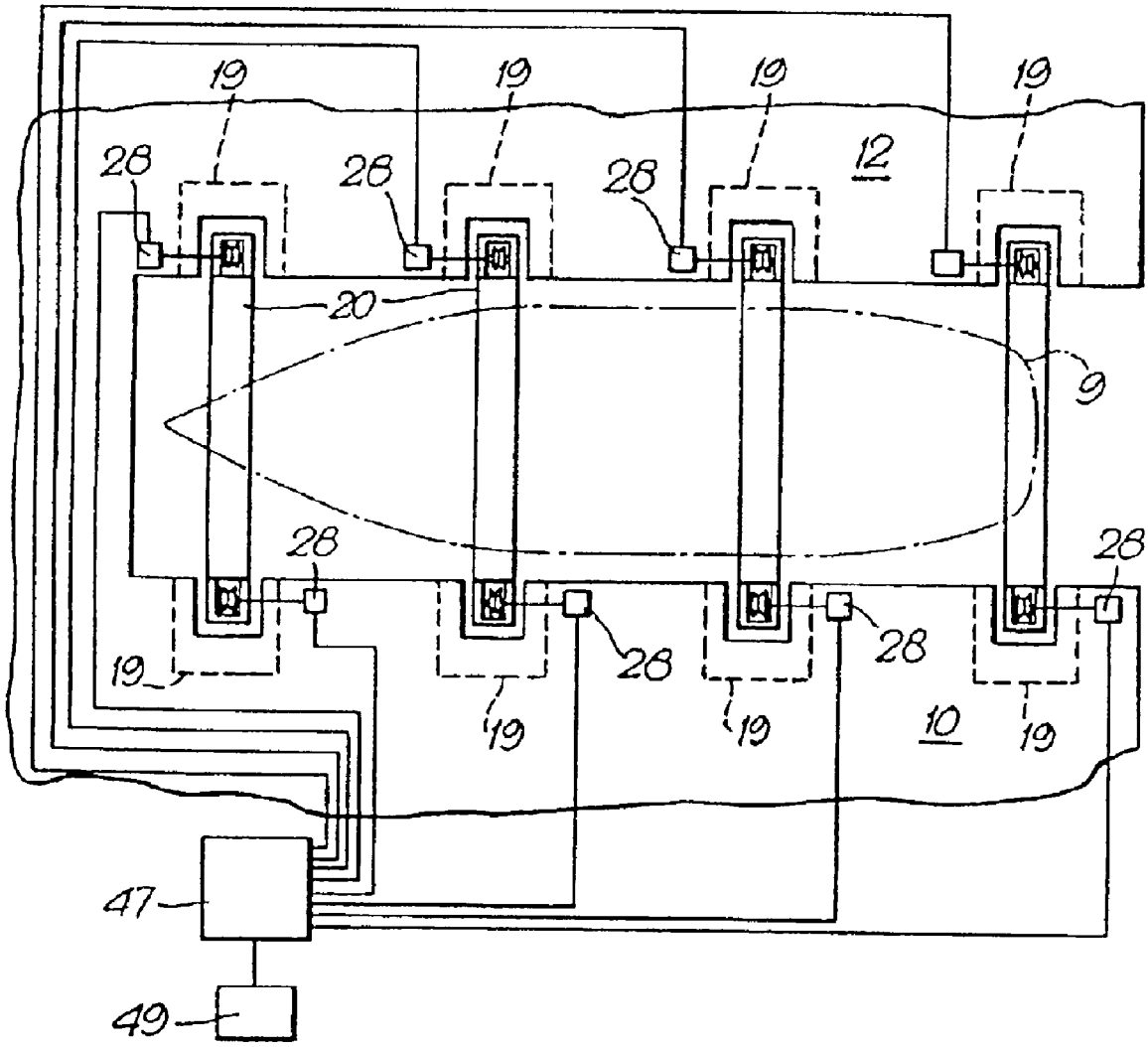
Fig. 4. (PRIOR ART)
FIG. 4 (Prior Art) is a partially schematic plan view of the shiplift of FIG. 1.

The present invention includes several modes of operating a shiplift. The first is an automatic jogging mode. When lifting a ship, the load on each main transverse beam of the platform is usually not uniform due to various factors, including the shape of the ship to be lifted, the loading of the ship, the blocking between the ship and the platform, etc. Under certain circumstances, one or more MTBs may be supporting either a higher or lower load than is desired with respect to the other MTBs. Because the MTBs are articulated with respect to one another, various height adjustments can be made, within a defined safe range, to individual transverse beams to affect the load they are supporting. This raising or lowering of individual MTBs with respect to other MTBs of the platform is referred to as "jogging". RE37,061, "Method of Distributing Loads Generated Between A Ship And A Supporting Dry Dock", described above discloses a prior art method of jogging MTBs to transfer loads between the MTBs of a platform.

As an example, because of the shape of a particular ship's hull and the configuration/placement of the blocking between the ship and the platform, it may be found that one MTB is supporting a significantly higher load than the adjacent MTBs. This can lead to a situation where the load on that MTB exceeds safe limits even though the remaining MTBs, and the overall platform itself, are still well within safe limits. In addition, since this same load on the highly loaded MTB is also applied to the locally supported area of the ship's hull, damage can occur to the ship's hull itself if the localized loading on the hull exceeds safe limits.

In another example, it may be found that one MTB is supporting a significantly lower load than the adjacent MTBs. In such a case, especially where the shiplift is lifting a ship near its safe operating limit, it may be desirable to transfer load from the mare heavily loaded adjacent MTBs to the more lightly loaded MTB.

In the first example, the load on the more heavily loaded MTB can be reduced by lowering that MTB with respect to the other MTBs, thus transferring some of the load from the heavily loaded MTB to the other MTBs of the platform. In the second example, the load on the lightly loaded MTB can be increased by raising that MTB with respect to the other MTBs, thus transferring some of the load from the other more heavily loaded MTBs to the more lightly loaded MTB. Jogging of individual MTBs of a platform can have significant benefits, as described above, but can also present significant risks if not performed by a skilled, knowledgeable operator. For instance, an individual MTB can only be raised or lowered so much with respect to adjacent MTBs before the difference in height can result in adjacent MTBs pulling apart their articulated joint and separating from one another, thereby creating a hazardous condition on the platform. Further, since the loads on proximally located MTBs are interrelated to some degree, too much movement of one MTB, either up or down, can result in overloading of that, or other MTBs. Therefore, the jogging process can only safely be performed by adhering to strict guidelines.

Figure 6:
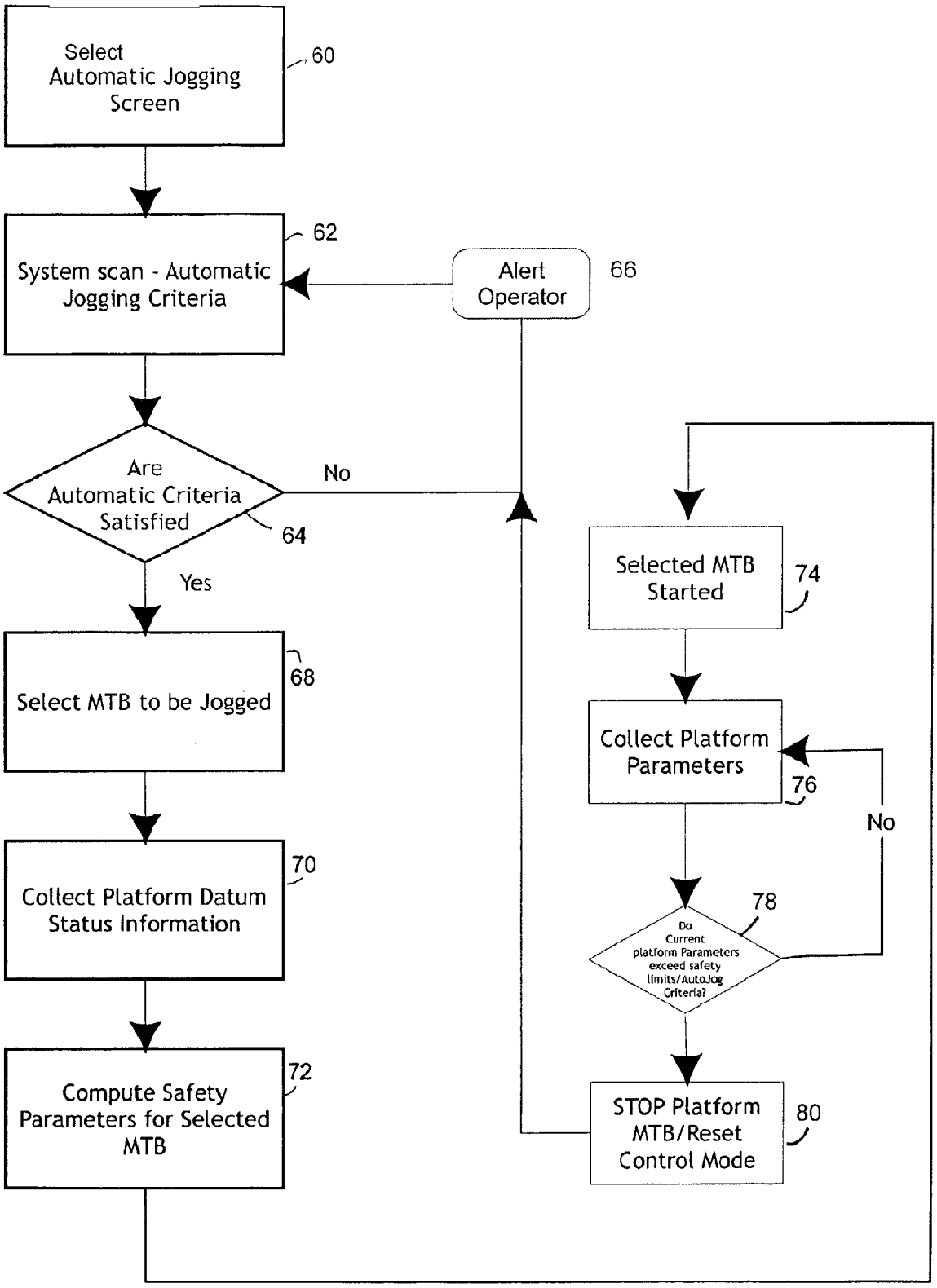
FIG. 6 is a logic flow chart of a first mode of the present invention.

FIG. 6 shows a method for operating the automatic jogging mode of the present invention. Prior to the lift operation commencing, the platform is put through a preliminary procedure where the base load on each MTB (i.e., the load of the platform and blocking) is ascertained and the platform goes through a leveling procedure to level the height of each MTB with respect to one another. Once the preliminary procedure is completed, the actual lifting operation can commence and the shiplift can be put into automatic jogging mode. In step 60, the automatic jogging screen of a shiplift control display is selected. This can be selected manually by the shiplift operator (for instance, via a keyboard, mouse or touchscreen) or can automatically be selected when the shiplift control system detects certain parameters that would indicate that jogging would be advantageous.

At step 62, a system scan is performed to determine if automatic jogging is desirable. This will entail, inter alia, sensing and analyzing the "tared" loads on each MTB. The tared load is the total load on the MTB (including the ship) less the base load to give the actual load of the ship itself. The system can also read the current position of the platform and individual MTBs. This can be done either through actual distance measurement, or through a calculated distance based, for instance, on the amount of time the electrical winch hoist 19 has been driven since the preliminary leveling operation. For example, if the hoist winch 19 moves the MTB at a rate of 25 mm per minute and the hoist winch has been driven for three minutes since the leveling operation, it can be calculated that the MTB has moved 75 mm.

Figure 5:
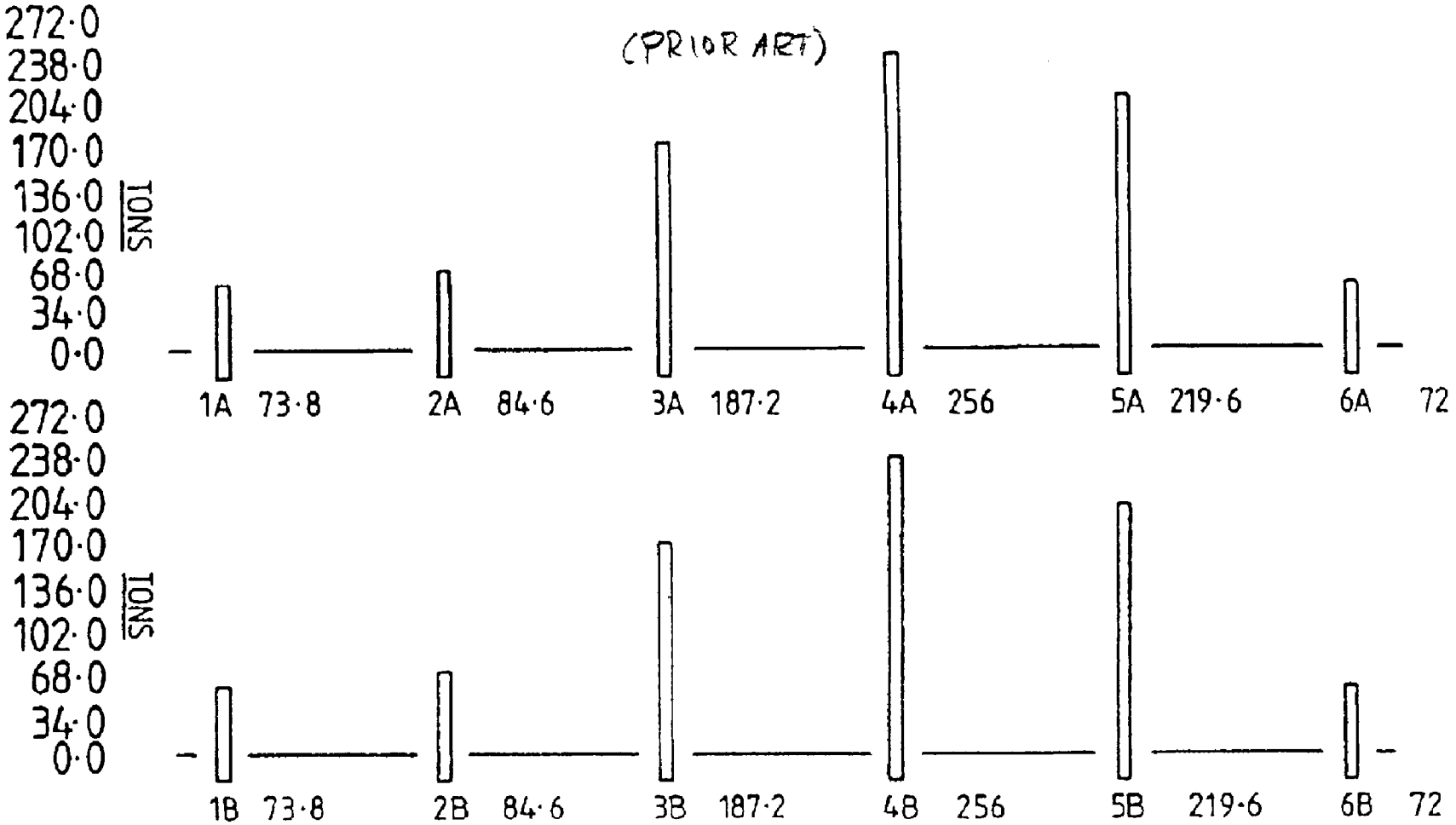
Fig.5. (PRIOR ART)
FIG. 5 (Prior Art) is a display of a weight distribution of a ship on the shiplift of FIG. 1.

Then it is determined if the load on art individual MTB is either greater or lesser than the load on other MTBs by a predetermined amount and/or whether the load on an individual MTB is approaching its safe limit. This factor can be considered in terms of actual load figures and/or ratios of loading between selected MTBs. The display 49 will preferably display the loading on each MTB, such as shown in FIG. 5, for instance. During this step, MTBs positioned near either the bow or the stern of the ship and which are expected to have significantly lighter loading than other MTBs can optionally be omitted from consideration. Another criterion that can be optionally considered at step 62 is whether an MTB which may be a candidate for jogging is still within a safe height adjustment range. This can take into account whether any previous jogging has been performed. Other criteria can also optionally be considered.

At step 64, it is determined whether the automatic jogging criteria are satisfied, indicating that automatic jogging is recommended. If not, the operator can be alerted at step 66 via the display 49 or other signal and the method returns to step 62, continuing cycling until it is determined that the automatic jogging criteria are satisfied or the program stopped. If the criteria are satisfied, the MTB to be jogged is selected at step 68. This can be done automatically by the system by suggesting which MTB should be automatically jogged based on the criteria. In such a case, the method can either continue automatically through the remaining steps described below or can ask for authorization from the operator before proceeding. Alternatively, the operator can select an MTB to be jogged.

At step 70, the system collects and stores the current tared load readings on each MTB, and can also collect and store the current position of each MTB. At step 72, the system calculates the safe parameters in which the selected MTB can be jogged. One factor is the maximum distance the MTB can be jogged. This can be calculated by comparing the designed allowable movement of the MTB (with respect to other MTBs) to the actual position of the MTB (with respect to other MTBs) to determine how much movement of the MTB will be permitted. Another factor is the maximum permitted load on the MTB, which can be preprogrammed into the system or accessed through a data table/file. Another factor can be the desired load on the MTB after jogging. At step 74, jogging of the selected MTB is commenced. This can be done by entering a special control mode of the system that allows movement of an individual MTB through operation of the associated hoist winches 19 while keeping the other MTBs stationary.

At step 76, the system collects the current platform parameters, including the loads on each MTB and the position of each MTB. It can also estimate loads using a load prediction factor based on the initial load and the amount of movement of the MTB. At step 78, the data collected at step 76 is compared with the safety parameters established at step 72 and it is determined whether the safety parameters have been reached or exceeded. To ensure that the system does not create any hazardous situations during this mode, the safety factors determined at step 72 can include built in safety margins so that actual safe operating limits are not exceeded at steps 74-78. Alternatively, step 78 can operate in a comparison mode where it signals that movement of the MTB should be stopped when it is determined that one or more of the current platform parameters have exceeded a certain proportion of one or more of the safety parameters determined at step 72. For instance, step 78 can signal that movement of the MTB should be stopped when the actual movement of the MTB has exceeded 90% of the permitted movement determined at step 72. Other comparison factors can also be used.

If the safety parameters have not been exceeded, the process returns to step 76 and continues cycling through steps 76 and 78, continuously monitoring the status of the shiplift until it is determined that one of the safety parameters has been met or exceeded, or until the desired load transfer has been accomplished, at which point, the process moves to step 80, the platform is stopped and the control mode is reset. The operator is then alerted of this at step 66 and the process returns to step 62.

This mode can also be used in a similar manner as described above to redistribute loads on opposite ends of an individual MTB by driving the hoist supporting one end of the MTB while keeping the hoist supporting the other end of the MTB stationary.

This mode, as well as the other modes described below, can be operated by the shiplift control system, which in the shiplift described above, would include computer/CPU 47 and display 49. It can also use other types of controllers, such as programmable logic controllers.

Figure 7:
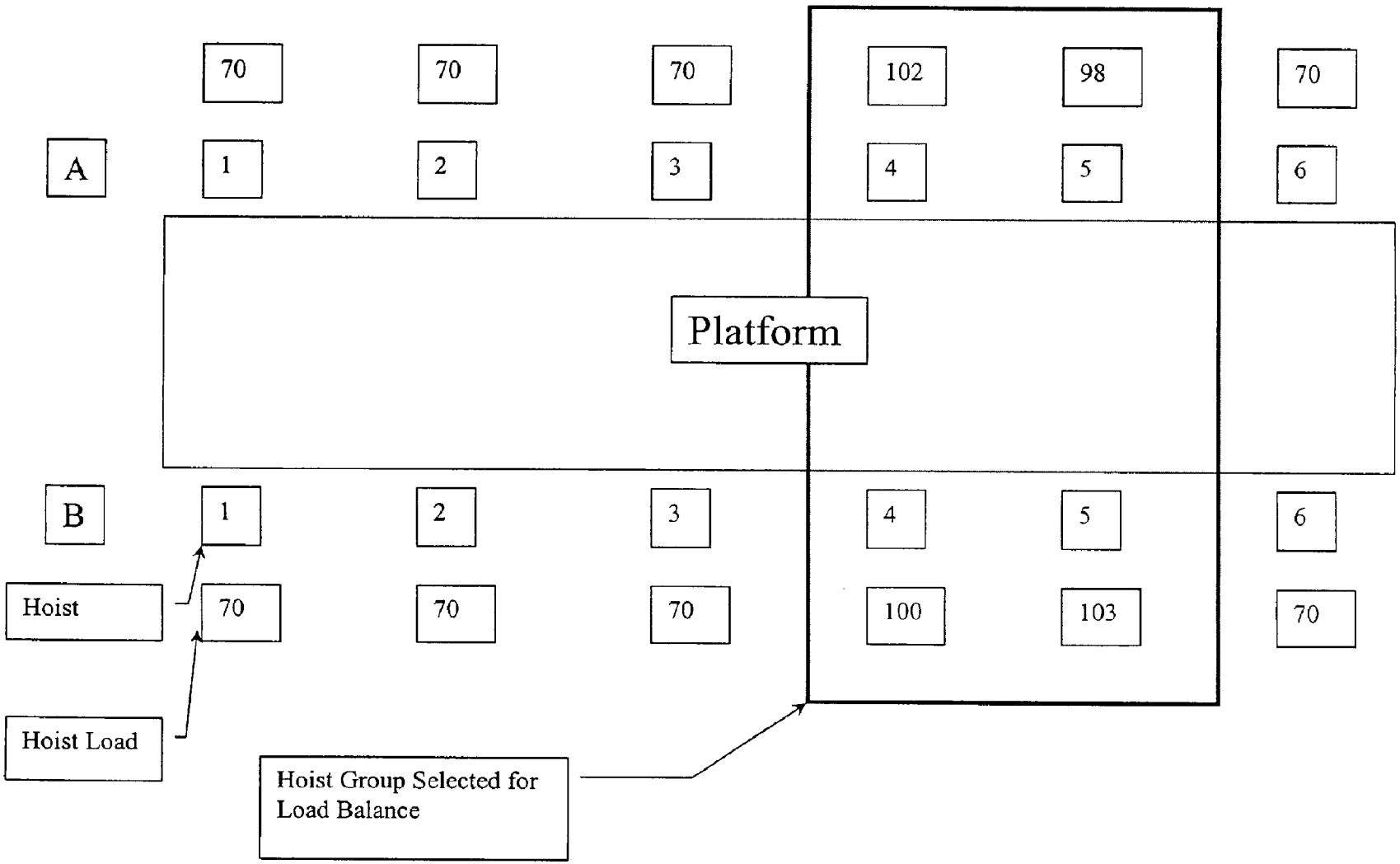
FIG. 7 is a schematic representation of a shiplift and the loads on each hoist.

The second mode of the method of the present invention is a load balance mode. It is similar to the automatic jogging mode described above, but instead of jogging a single MTB, groups of MTBs that are carrying disproportionate loads as compared to other MTBs are jogged in unison. See FIG. 7, which is a schematic representation of a shiplift. As shown there, the group of hoists A4, A5, B4 and B5 are carrying a disproportionately higher load than the other hoists. In such a circumstance, it can be desirable to redistribute the load to more evenly balance the load amongst all of the hoists/MTBs. In this situation, the selected group would desirably be lowered with respect to the other MTBs to transfer a portion of the load to the other MTBs.

Figure 8:
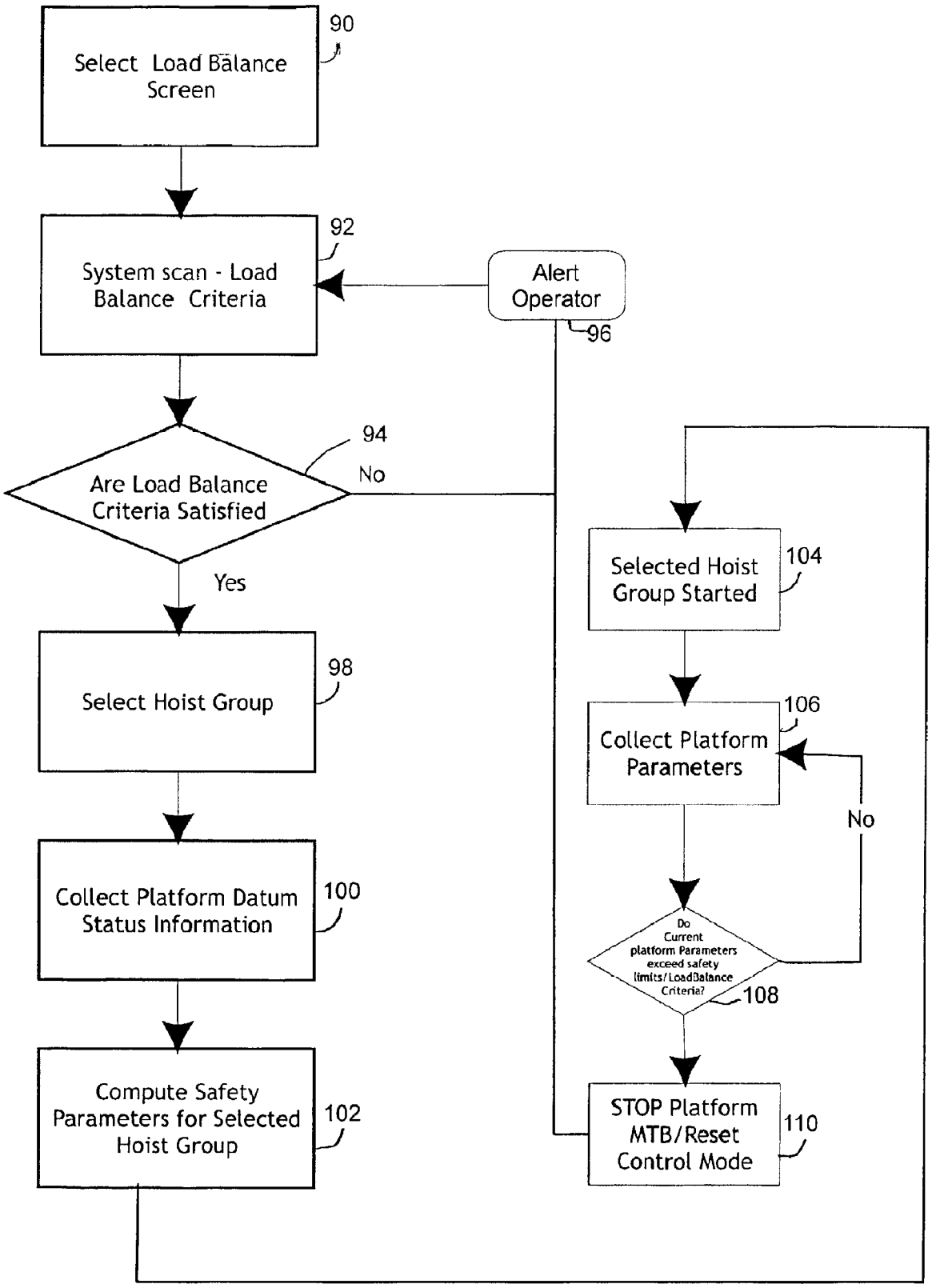
FIG. 8 is a logic flow chart of a second mode of the present invention.

The mode operates similarly to the automatic jogging mode, although different calculations and analysis of various groups of hoists/MTBs may be employed. FIG. 8 shows a method for operating the load balance mode of the present invention. Prior to the lift operation commencing, the platform is put through a preliminary procedure as with the automatic jogging mode above. Once the preliminary procedure is completed, the actual titling operation can commence and the shiplift can be put into load balance mode. In step 90, the load balance screen of the shiplift control display is selected. This can be selected manually by the shiplift operator or can automatically be selected when the shiplift control system detects certain parameters that would indicate that load balancing would be advantageous.

At step 92, a system scan is performed to determine if load balancing is desirable. This will entail, inter alia, sensing and analyzing the tared loads on each MTB, as well as grouping the loads certain MTBs and comparing such loads with the loads on other groups of MTBs. The system can also read the current position of the platform and individual MTBs. Then it is determined if the load on a group of MTBs is either greater or lesser than the load on other MTBs by a predetermined amount and/or whether the load on a group of MTBs is approaching a safe limit. During this step, MTBs positioned near either the bow or the stern of the ship and which are expected to have significantly lighter loading than other MTBs can optionally be omitted from consideration. Another criterion that can be optionally considered at step 72 is whether a group of MTBs which may be a candidate for jogging is still within a safe height adjustment range. This can take into account whether any previous jogging has been performed. Other criteria can also optionally be considered.

At step 94, it is determined whether the load balancing criteria are satisfied, indicating that load balancing is recommended. If not, the operator can be alerted at step 96 via the display 49 or other signal and the method returns to step 92, continuing cycling until it is determined that the load balancing criteria are satisfied or the program stopped. If the criteria are satisfied, the group of MTBs (hoists) to be jogged is selected at step 98. This can be done automatically by the system by suggesting which group of MTBs should be automatically jogged based on the criteria. In such a case, the method can either continue automatically through the remaining steps described below or can ask for authorization from the operator before proceeding. Alternatively, the operator can select a group of MTBs to be jogged.

At step 100, the system collects and stores the current tared load readings on each MTB, and can also collect and store the current position of each MTB. At step 102, the system calculates the safe parameters in which the selected group of MTBs can be jogged. One factor is the maximum distance the MTBs can be jogged. This can be calculated by comparing the designed allowable movement of the selected group of MTBs (with respect to other MTBs) to the actual position of the selected group of MTBs (with respect to other MTBs) to determine how much movement of the selected group of MTBs will be permitted. Another factor is the maximum permitted load on the selected group of MTBs, which can be preprogrammed into the system or accessed through a data table/file. Another factor can be the desired loads on the selected group of MTBs after jogging. At step 104, jogging of the selected group of MTBs is commenced. This can be done by entering a special control mode of the system that allows movement of a group of MTBs through operation of the associated hoist winches 19 while keeping the other MTBs stationary.

At step 106, the system collects the current platform parameters, including the loads on each MTB and the position of each MTB. It can also estimate loads using a load prediction factor based on the initial load and the amount of movement of the MTB. At step 108, the data collected at step 106 is compared with the safety parameters established at step 102 and it is determined whether the safety parameters have been reached or exceeded, in the same manner as described above with respect to the automatic jogging mode. If the safety parameters have not been exceeded, the process returns to step 106 and continues cycling through steps 106 and 108, continuously monitoring the status of the shiplift until it is determined that one of the safety parameters has been met or exceeded, at which point, the process moves to step 110, the platform is stopped and the control mode is reset. The operator is then alerted of this at step 96 and the process returns to step 92.

The third mode of the method of the present invention is a discontinuous blocking mode. The interface between the ship and the platform is the transfer system. Each discrete cradle has winged blocks capped with wood that support the vessel on the platform. The transfer system is spaced at regular intervals to suit ether the vessel/loading form or an operational requirement. The existing ATLAS™ system provides a calculated load distribution screen, as described above, to enable the operator to input various docking parameters but assumes a uniform, continuous blocking, i.e., a fixed, uniform distance between each pair of blocks. The system then calculates and displays a load distribution assuming a trapezoidal loading curve.

In some cases it may be necessary to dock a vessel that has either a special feature on the hull or has some hull damage. This situation may dictate a break in the regular blocking spacing, i.e., the blocking arrangement will be discontinuous or interrupted. This has a significant effect on the magnitude and distribution of the resultant trapezoidal loading curve. This third mode allows the operator to input details of the discontinuous blocking so that the loading parameters and loading curve can be correctly calculated and analyzed to determine if the proposed arrangement of blocking will be sufficient to properly support the ship.

Figure 9:
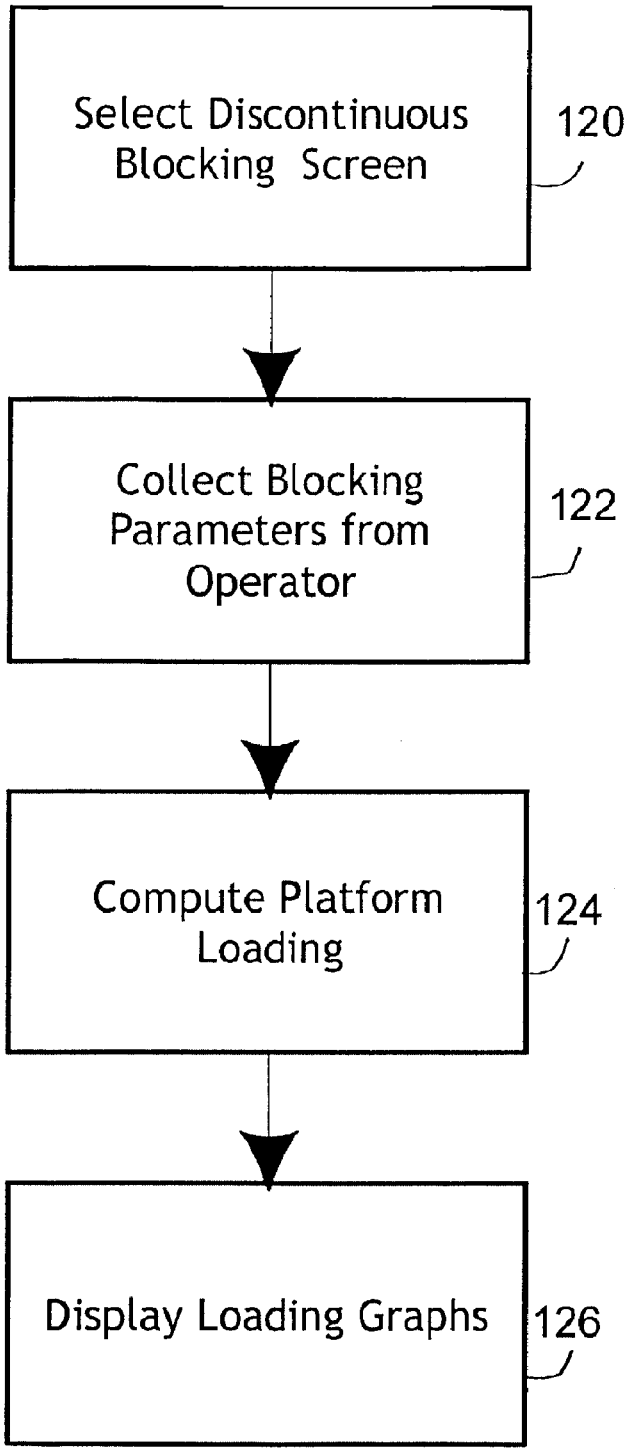
FIG. 9 is a logic flow chart of a third mode of the present invention.

FIG. 9 shows a logic flow chart for this mode. In step 120, the operator selects the blocking screen, in a manner as described above. At step 122, the system collects the blocking information from the operator as to the specific blocking arrangement proposed. This can include, inter alia, the longitudinal start position of the blocking arrangement, the spacing between the block sets, including any gaps in the blocking cradle train, the vessel mass and the estimated longitudinal center of gravity. The system then computes the platform loading based on this information at step 124 and graphically displays the estimated loading curve(s) at step 126 for the proposed blocking arrangement. This can be analyzed by the operator to determine whether the proposed blocking will properly support the ship, or whether adjustments need to be made to the blocking arrangement. The system can also be configured to automatically analyze the estimated loading curve and provide a visual or other warning if the estimated loading curve will exceed safe operating limits in any manner. In such an event, this mode can also be configured to automatically suggest a revised blocking arrangement that will provide an estimated loading curve that falls within safe operating limits.

The fourth mode of the method of the present invention is a block load estimation. This mode estimates the load that will be supported by the blocking elements themselves and can be used to predict higher than desired loading on the blocking elements that might cause damage to the ship's hull.

Figure 10:
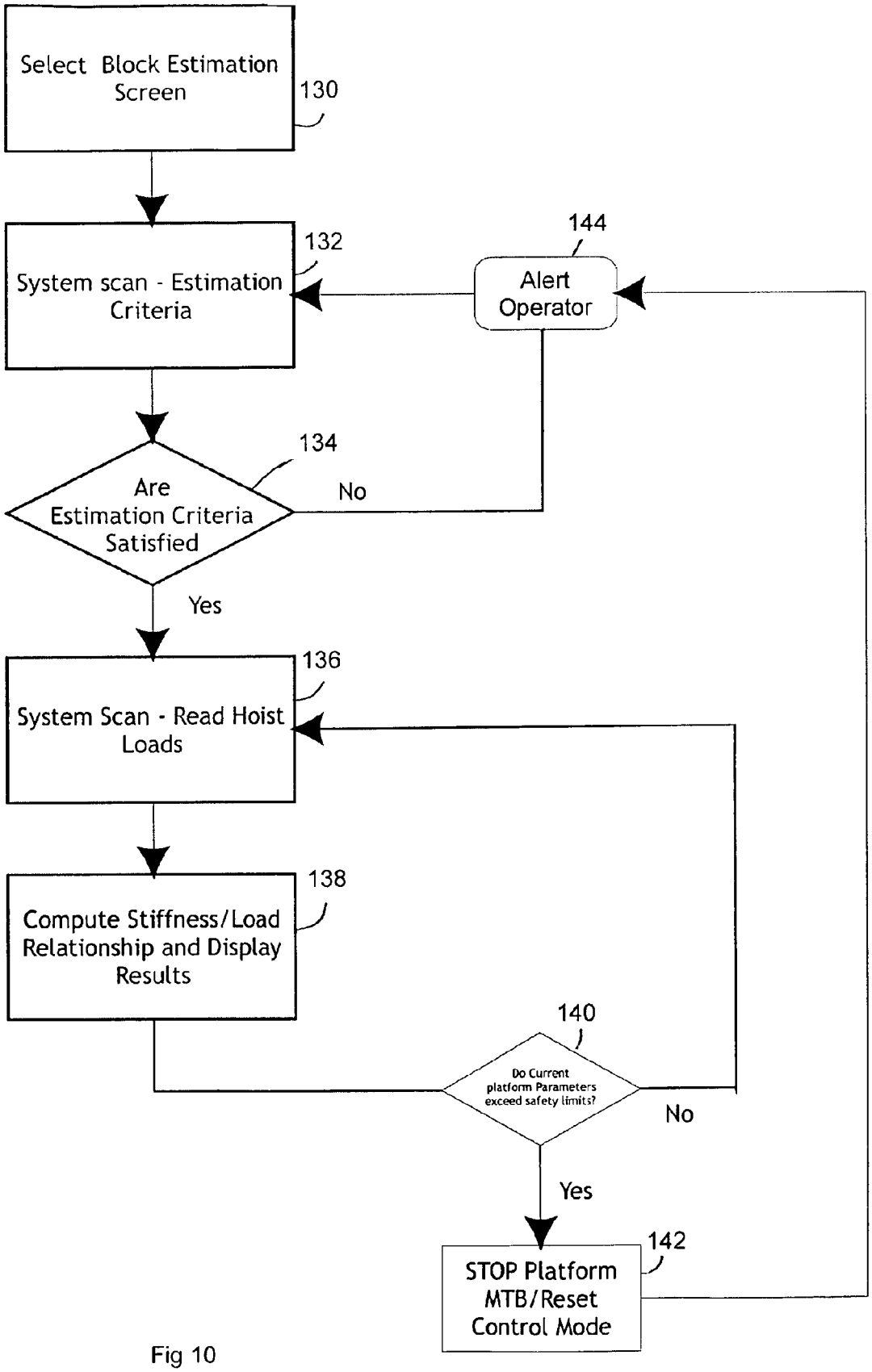
FIG. 10 is a logic flow chart of a fourth mode of the present invention.

FIG. 10 shows a logic flow chart for this mode. In step 130, the operator selects the block load estimation screen, in a manner as described above. In step 132, the system performs a scan, reading the tared load values on each hoist and the current platform position. At step 134, the system determines whether the blocking estimation criteria are met. For instance, this mode is not available during all docking operations, such as, for example, if the platform was pinned to the quays. If not, the system can return to step 132 and cycle until the criteria are met, whereupon, the system moves to step 136. At step 136, the system stores the current tared load readings for each hoist for comparison purposes during platform movements.

The system then moves to step 138, where it computes the block load based on the instantaneous hoist loads, the number/positioning of the blocks and a known relationship between the platform system stiffness and load. In a normal lift operation, each MTB will have a blocking set. This will usually include a center block positioned under the keel of the ship which supports the majority of the weight and a pair of wing blocks positioned to the port and starboard of the keel block to provide support against the ship tipping. The number/positioning of the blocks can be based on this normal relationship or the system can provide for the entry of data relating to a different blocking arrangement, such as a discontinuous blocking arrangement discussed above, by entering, for instance, the number and positioning of each block. The system then determines whether any of the current platform parameters exceed predetermined safety criteria. If not, the system returns to step 136 and continues cycling through steps 136-140, monitoring the estimated block loading until either the lift operation is stopped or, a safety parameter is exceed. If a safety parameter is exceed, the system moves to step 142, where it stops the platform, resets the control mode and provides a visual or other warning to the operator.

The fifth mode of the method of the present invention is a tons per meter mode. One of the basic design criteria of certain types of articulated shiplift platforms is the identification of a Maximum Distributed Load (MDL) along the platform. This coupled with the hoist capacity drives the setting of the various protection trip levels. A Tons per Meter (TPM) mode and display can provide a graphical representation of the MDL and can be calculated from the hoist loads. The designer's unique knowledge of the structural response of the articulated platform enables this calculation to be performed. One of the benefits of this display includes the provision of extra platform protection in a situation where the transfer system load approaches a design limit that does not manifest itself in a high hoist load, and the platform is therefore not afforded the safety protection derived from the hoist load. That is, the load does not approach the safety limits on an individual MTB basis and therefore triggers no warnings via hoist overload, but the load across several MTBs can exceed the platform safety limit.

Figure 11:
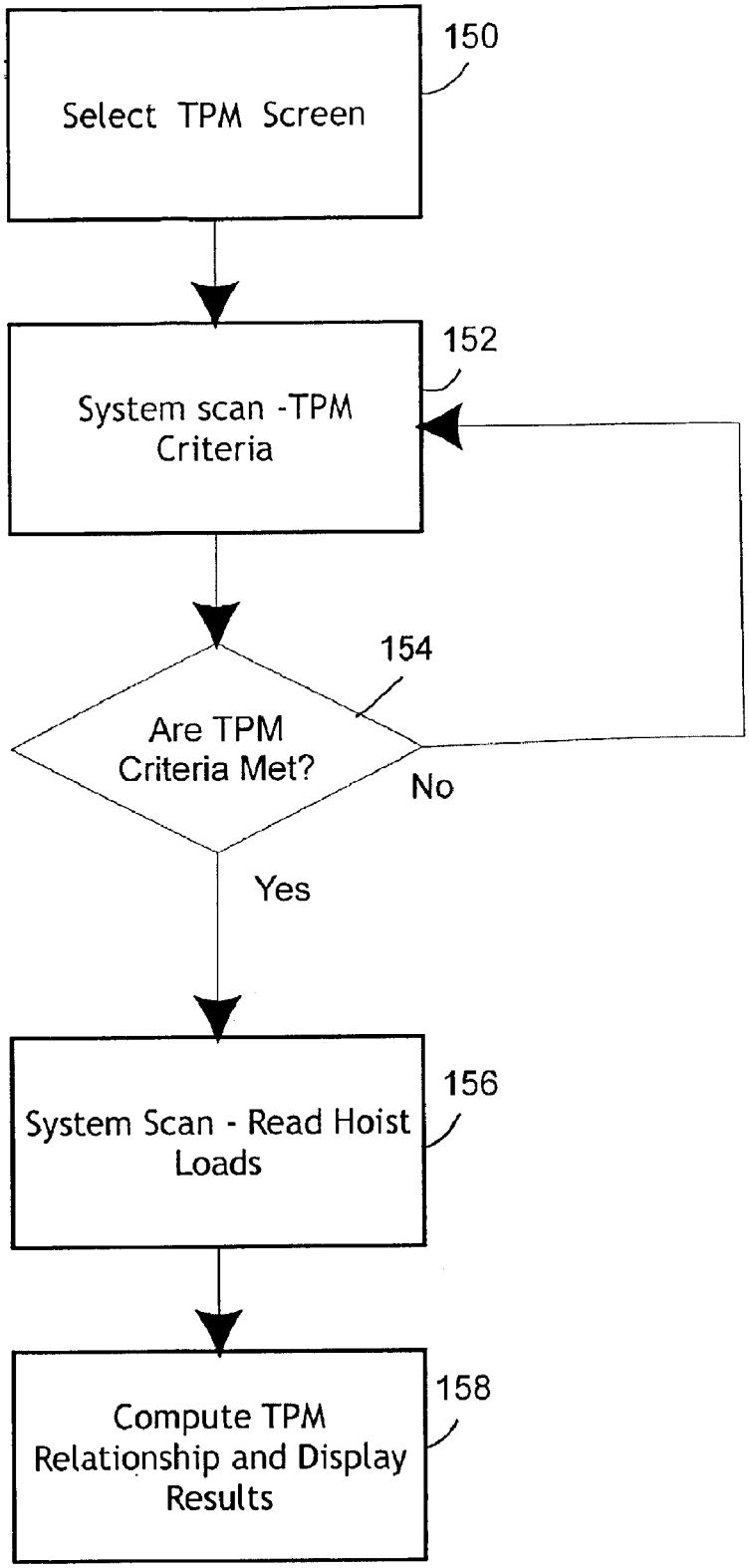
FIG. 11 is a logic flow chart of a fifth of the present invention.

FIG. 11 shows a logic flow chart for this mode. In step 150, the operator selects the TPM screen, in a manner as described above. In step 152, the system reads the tared load values on each hoist and the current platform position. At step 154, the system determines whether the TPM criteria are met. If not, the system returns to step 152 and cycles through steps 152-154 until the operation is stopped or the criteria are met. If they are met, at step 156, the system stores the current tared load readings for each hoist to be used in the tons per meter calculation. At step 158, the system calculates the TPM and displays the results. Since the TPM is an estimation, this mode can stop here after display of the results. However, this mode can also be used to alert the operator and stop the platform if the TPM exceeds certain predetermined safety parameters, until the operator can analyze the situation. In such a case, the logic flow chart could continue on in a manner as discussed above with respect to other modes.

The sixth mode of the method of the present invention is an automatic replay mode. In analyzing a ship lifting operation, especially if there have been problems during the lifting operation, it can be helpful to review the sequence of actions occurring during the lift. This can point out if and how an error occurred and can also be used as a training tool for operators. This mode is preferably not selectable or deselectable by the operator. Rather, it commences upon booting up of the shiplift control system and can maintain a running log of shiplift activities for a desired length of time, with appropriate memory assigned for maintaining the desired length of log. This mode can operate in different submodes. In a first submode, upon system boot, the system can maintain a running log of all shiplift activities, or a log of all preselected activities, for some length of time. In a second submode, upon system boot, the system can run in a continuous monitoring (but not logging) phase until some criteria is met indicating that logging of the data should be performed.

Figure 12:
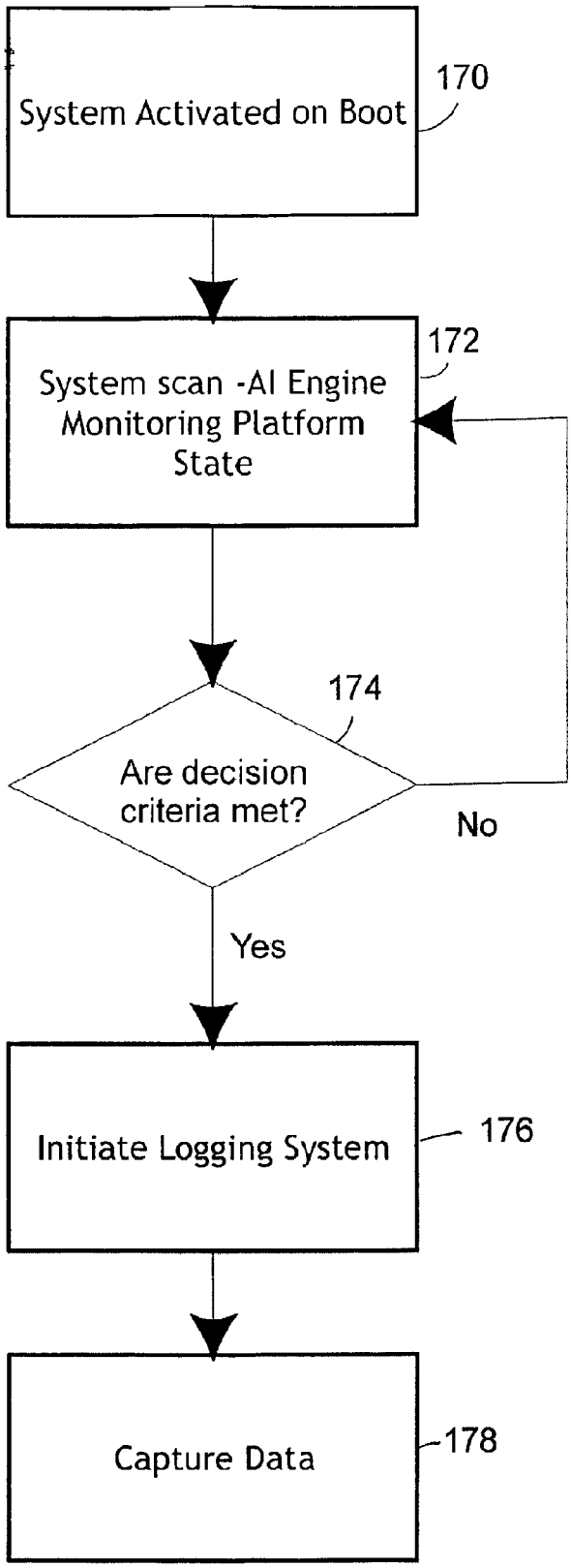
FIG. 12 is a logic flow chart of a sixth mode of the present invention.

FIG. 12 shows a logic flow chart for this second submode. In step 170, this mode is activated upon boot up of the system. A system scan is performed at step 172 and can use an Artificial Intelligence Engine to monitor the state of the shiplift. During normal operation of the shiplift, the system continually monitors various lift parameters. At step 174, the system determines whether any of these parameters indicate that logging of the data should begin. If not, the system returns to step 172 and continues cycling through steps 172-174 until the system is shut down or the data indicates that logging should begin. If the data indicates that logging should begin, the system moves to step 176, where the logging system is initiated and then to step 178 where the data is captured and stored to a persistent memory. The data of the desired shiplift parameters can be logged at predetermined time intervals. The system can continue logging the data until system shutdown or until some further criteria are met. The logged data then can be accessed at a later point by an authorized operator. The parameters that can be monitored and logged include the load on each hoist, the motor current draw for each hoist and the position of each MTB.

The various modes described above can be used individually or simultaneously in various combinations.

Although the present invention has been discussed in relation to the type of shiplift described in the Background section hereof, it is to be understood that its use is not limited to such a shiplift and that it can be used with other types of shiplifts or other types of lifting mechanisms.

The present invention is intended to operate automatically when activated, in conjunction with and/or through the control system for the lifting mechanism. Alternatively, the present invention can be embodied in a separate cpu/controller to operate separately from the control system for the lifting mechanism, but in conjunction with the control system when required. While not preferred, certain of the steps of the present invention can be operated manually and/or upon query and or indication by the system of the present invention. The present invention also includes a system for enacting one or more of the steps of the methods of the invention.

What is claimed is:

1. A method for operating a lifting mechanism having a platform and a plurality of irregularly spaced blocking mechanisms to support a load of an item to be lifted on the platform, comprising:

collecting position data on each of the blocking mechanisms with respect to the platform;

estimating a mass of the item to be lifted;

estimating a longitudinal center of gravity of the item to be lifted;

calculating an estimated loading curve on the platform based on the position of the irregularly spaced blocking mechanisms, the mass and longitudinal center of gravity of the item to be lifted; and outputting the estimated loading curve.

2. A method as in claim 1, and further comprising providing a warning if the estimated loading curve exceeds predetermined parameters.

3. A method as in claim 1, wherein, when the estimated loading curve exceeds predetermined parameters, suggesting a revised spacing arrangement for the blocking mechanisms that provides a new estimated loading curve that falls within the predetermined parameters.

4. A method as in claim 1, wherein the lifting mechanism includes a plurality of hoists to lift the platform, comprising:

reading a load on each hoist;

calculating a load on each blocking mechanism based on the position of each blocking mechanism, the loads on each hoist and a predetermined relationship between a stiffness of the platform and its load;

outputting the calculated load on each blocking mechanism.

5. A method as in claim 4, and further comprising comparing the calculated load on each blocking mechanism to predetermined parameters and providing a warning if the calculated load on any blocking mechanism exceeds the predetermined parameters.

6. A method as in claim 5, and further comprising comparing the calculated load on each blocking mechanism to predetermined parameters and stopping a lifting operation if the calculated load on any blocking mechanism exceeds the predetermined parameters.

7. A method as in claim 1, wherein the lifting mechanism includes a plurality of hoists to lift the platform, comprising:

reading a load on each hoist;

calculating an estimated tons per meter loading on the platform based on the load on each hoist, the positioning of each blocking mechanism and a length of the platform; and outputting the estimated tons per meter calculation.

8. A method as in claim 7, and further comprising comparing the estimated tons per meter to predetermined parameters and providing a warning if the estimated tons per meter exceeds the predetermined parameters.

9. A method as in claim 7, and further comprising comparing the estimated tons per meter to predetermined parameters and stopping a lifting operation if the estimated tons per meter exceeds the predetermined parameters.

10. A method as in claim 1, comprising:

activating a monitoring operation of the lifting mechanism upon start-up of the lifting mechanism;

monitoring certain operating parameters of the lifting mechanism;

comparing the operating parameters with predetermined trigger parameters; and logging the operating parameters in the event that any of the trigger parameters are met.

11. A method as in claim 10, wherein the operating parameters monitored include a load on each hoist of the lifting mechanism, a motor current draw of each hoist and a position of each main transverse beam of a platform of the hoist.

12. A method as in claim 1, comprising:

activating a monitoring system upon activation of a lifting mechanism control;

selecting a set of system parameters to monitor;

selecting a set of triggering criteria for at least certain of the system parameters;

monitoring the system parameters until any of the triggering criteria met; and logging the system parameters to a persistent memory once any of the triggering criteria are met.

13. A method as in claim 1, wherein the platform including a plurality of main transverse beams ("MTBs"), each MTB supported by at least one hoist, comprising:

reading a load on each MTB;

determining whether the load on any MTB is different from the load on any other MTB by more than a predetermined amount;

selecting at least one MTB which has a load different from the load on any other MTB by more than a predetermined amount;

determining at least one safety limit by which the selected MTB can be vertically moved with respect to adjacent MTBs;

vertically moving the selected MTB with respect to the other MTBs within the safety limit to transfer load between the selected MTB and the other MTBs;

monitoring the loads on each MTB and the position of the selected MTB as vertical movement of the selected MTB proceeds;

comparing the monitored loads and position with the safety limit; and stopping the movement of the selected MTB when either the desired load transfer is completed or the safety limit has been met.

14. A method as in claim 13, wherein determining the safety limit includes comparing the actual position of the selected MTB with respect to adjacent MTBs and comparing this to an allowable range of movement between adjacent MTBs.

15. A method as in claim 13, wherein determining the safety limit includes limiting movement to that which will not allow a load on any MTB to exceed a maximum permitted load on the MTB.

16. A method as in claim 13, wherein a group of MTBs having respective loads different from the loads on other MTBs by more than a predetermined amount is selected and vertically moved with respect to the other MTBs.

17. A method as in claim 13, wherein only a first end of the selected MTB is vertically moved with respect to the other MTBs and a second end of the selected MTB is maintained vertically stationary.

18. A method as in claim 13, wherein certain MTBs of the platform are excluded from consideration in selecting the MTB to be moved.

19. A method as in claim 13, wherein the selected MTB is lowered to transfer load from it to other MTBs.

20. A method as in claim 13, wherein the selected MTB is raised to transfer load from other MTBs to it.

* * * * *